US008390517B2

(12) United States Patent
Chiang et al.

(10) Patent No.: US 8,390,517 B2
(45) Date of Patent: Mar. 5, 2013

(54) WIRELESS SIGNAL ANTENNA

(75) Inventors: Yuh-Yuh Chiang, Taipei (TW); Shang-Ching Tseng, Taipei (TW)

(73) Assignee: Wistron NeWeb Corp., Hsichih, Taipei (TW)

( * ) Notice: Subject to any disclaimer, the term of this patent is extended or adjusted under 35 U.S.C. 154(b) by 384 days.

(21) Appl. No.: 12/623,979

(22) Filed: Nov. 23, 2009

(65) Prior Publication Data

US 2010/0127941 A1 May 27, 2010

(30) Foreign Application Priority Data

Nov. 21, 2008 (TW) ..... 97145112 A

(51) Int. Cl.
*H01Q 1/38* (2006.01)
*H01Q 1/24* (2006.01)

(52) U.S. Cl. ..... 343/700 MS; 343/702; 343/829; 343/846

(58) Field of Classification Search ..... None
See application file for complete search history.

(56) References Cited

U.S. PATENT DOCUMENTS 6,812,892 B2 11/2004 Tai et al.
6,844,853 B2 * 1/2005 Tai et al. ..... 343/700 MS
6,864,841 B2 * 3/2005 Dai et al. ..... 343/700 MS
6,897,810 B2 * 5/2005 Dai et al. ..... 343/700 MS
7,119,747 B2 * 10/2006 Lin et al. ..... 343/702
7,825,863 B2 * 11/2010 Martiskainen et al. ..... 343/702
7,911,390 B2 * 3/2011 Chiu ..... 343/700 MS
8,125,390 B2 * 2/2012 Kuramoto et al. ..... 343/700 MS
2004/0017319 A1 * 1/2004 Wang et al. ..... 343/702
2004/0090377 A1 * 5/2004 Dai et al. ..... 343/700 MS
2004/0104853 A1 * 6/2004 Chen ..... 343/702

FOREIGN PATENT DOCUMENTS

TW M257521 2/2005

* cited by examiner

*Primary Examiner* — Trinh Dinh
(74) *Attorney, Agent, or Firm* — Muncy, Geissler, Olds & Lowe, PLLC

(57) ABSTRACT

The invention discloses a wireless signal antenna including a substrate, a grounding element, a metal radiator element, a signal transmission line, and a ground connection part. The metal radiator element includes a first radiator unit, a second radiator unit, and a signal feed-in point. The ground connection part is electrically connected to the signal feed-in point and the grounding element. The first radiator unit is disposed on the substrate and bent to include a first radiator part, a second radiator part, and a third radiator part, wherein at least a part of the first radiator unit is disposed along edges of the substrate. The second radiator unit is disposed between the first radiator unit and the grounding element. The signal transmission line includes a signal line and a ground line respectively connected to the signal feed-in point and a layout area of the grounding element. The signal transmission line receives electrical signals from a signal source and then excites the metal radiator element to generate a first frequency band mode and a second frequency band mode.

11 Claims, 5 Drawing Sheets

WIRELESS SIGNAL ANTENNA

BACKGROUND OF THE INVENTION

Related Application

This application claims priority under 35 U.S.C. 119 from TAIWAN Application ser. no. 097145112, filed Nov. 21, 2008, the contents of which are incorporated herein by reference.

1. Field of the Invention

This invention relates to a wireless signal antenna and more specifically to a dual-band wireless signal antenna.

2. Description of the Prior Art

In recent years, various wireless communication network technologies and standards have been continuously improved and released to increase the quality and quantity of wireless communications. For instance, the Wi-Fi wireless network standard previously defined in 802.11 by the Institute of Electrical and Electronics Engineers (IEEE) and the Worldwide Interoperability for Microwave Access (WiMAX) recently defined in 802.16 are examples of the wireless communication standards. Especially for WiMAX, the transmission distance has been increased from several meters to several kilometers and the bandwidth becomes wider over the piror art.

In order to match up the progress in wireless communication technology, the antenna's performance in receiving and transmitting wireless signals need to be improved accordingly. FIG. 1 illustrates a conventional dual-band antenna disclosed in the U.S. Patent U.S. Pat. No. 6,861,986. The conventional dual-band antenna has a first radiator 1 and a second radiator 2, both electrically connected to a grounding area 4. Signals are fed into the conventional dual-band antenna via the feed-in point 3 in a direct feed-in manner to excite the first radiator 1 to generate a high frequency band mode, whose centre frequency falls on substantially 5.25 GHz. The signals can also excite the second radiator 2 to generate a low frequency band mode, whose centre frequency falls on substantially 2.45 GHz. Furthermore, the effective length of the second radiator 2 is approximately one quarter of the wavelength of the signals radiated by the second radiator 2.

Signals are fed into the conventional dual-band antenna in a direct feed-in manner generating a bandwith of approximately 200 MHz in the low frequency band mode, and thus do not satisfy the broad-band requirement of WiMAX. Furthermore, the length of the second radiator 2 cannot be further reduced because of the operating frequencies of the low frequency mode, and therefore the size reduction of electronic devices is restricted.

SUMMARY OF THE INVENTION

It is an object of the present invention to provide a wireless signal antenna having reduced size and requiring less accommodation space.

It is another object of the present invention to provide a wireless signal antenna to be disposed on an electronic device to reduce a required overall volume of the electronic device.

The wireless signal antenna of the invention includes a substrate, a grounding element, a metal radiator element, a ground connection part and a signal transmission line, wherein the grounding element is disposed at one end of the substrate. The metal radiator element includes a first radiator unit, a second radiator unit, and a signal feed-in point. One end of the ground connection part is electrically connected to the signal feed-in point, while the other end is electrically connected to the grounding element. The overall length of the first radiator unit is greater than that of the second radiator unit. The first radiator unit and the second radiator unit are metal strips or metal microstrips having suitable geometric shapes and are printed on a first surface of the substrate. Furthermore, the first radiator unit has a first radiator part, a second radiator part, and a third radiator part, wherein at least a part of the first radiator unit is disposed along edges of the substrate.

In one embodiment, the wireless signal antenna includes a first semi-open area formed between the first radiator unit and the second radiator unit. In other words, the first semi-open area is a space on the substrate enclosed by the both the first radiator unit and the second radiator unit. The first semi-open area has a first opening. In one embodiment, the first opening is formed on one side of the substrate, but is not limited thereto. In other embodiments, the shape of the first semi-open area and the position of the first opening can be changed in accordance with the arrangement of the first radiator unit and the second radiator unit. Furthermore, in other embodiments, a second semi-open area is formed between the second radiator unit and the ground connection part or between the second radiator unit and the grounding element.

The signal transmission line includes a signal line and a ground line. The ground line is electrically connected to the grounding element. The signal line is electrically connected to the signal feed-in point and receives an electrical signal from a signal source. The electrical signal is then used to excite the metal radiator element to generate a high frequency band mode and a low frequency band mode. The high frequency band mode includes the 5 GHz frequency band defined in the wireless local area network standard IEEE 802.11. The low frequency mode includes the 2.4 GHz frequency band also defined in the IEEE 802.11 standard.

DETAILED DESCRIPTION OF THE PREFERRED EMBODIMENT

The present invention provides a wireless signal antenna. In an embodiment, the wireless signal antenna of the invention is used in various types of electronic devices for wireless signal transmissions. The above-mentioned electronic devices include laptop computers, desktop computers, mobile phones, personal digital assistants, and video game consoles. The wireless signals received can be applied in wireless local area network (WLAN), worldwide interoperability for microwave access (WiMAX), other types of wireless communications, or other technologies requiring wireless signal antenna.

Figure 1:
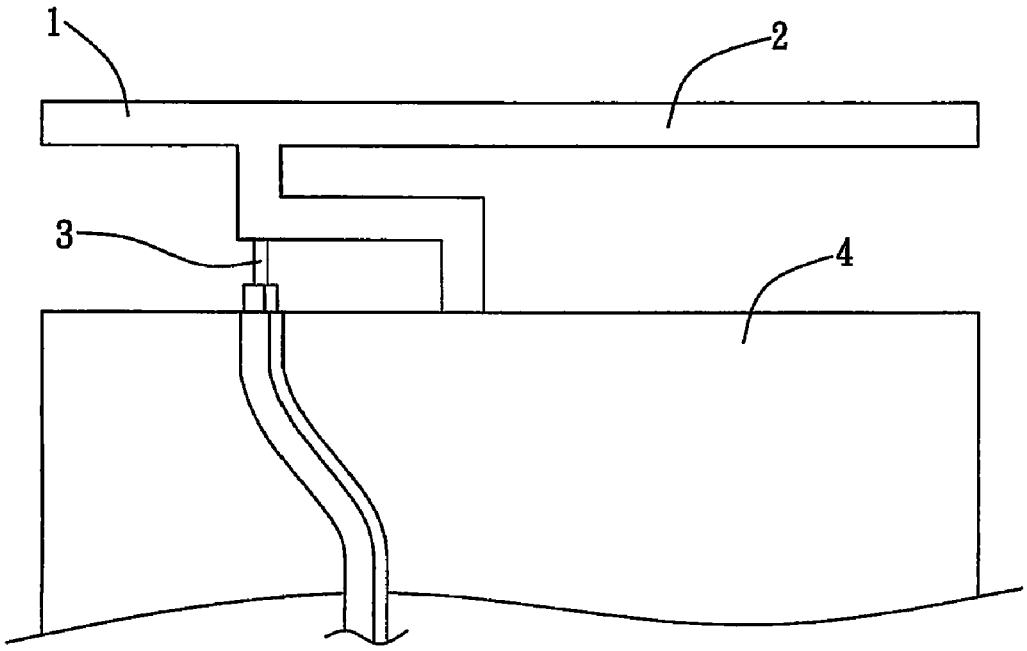
FIG. 1 (PRIOR ART)
FIG. 1 is a schematic view of a conventional dual-band antenna.
Figure 2A:
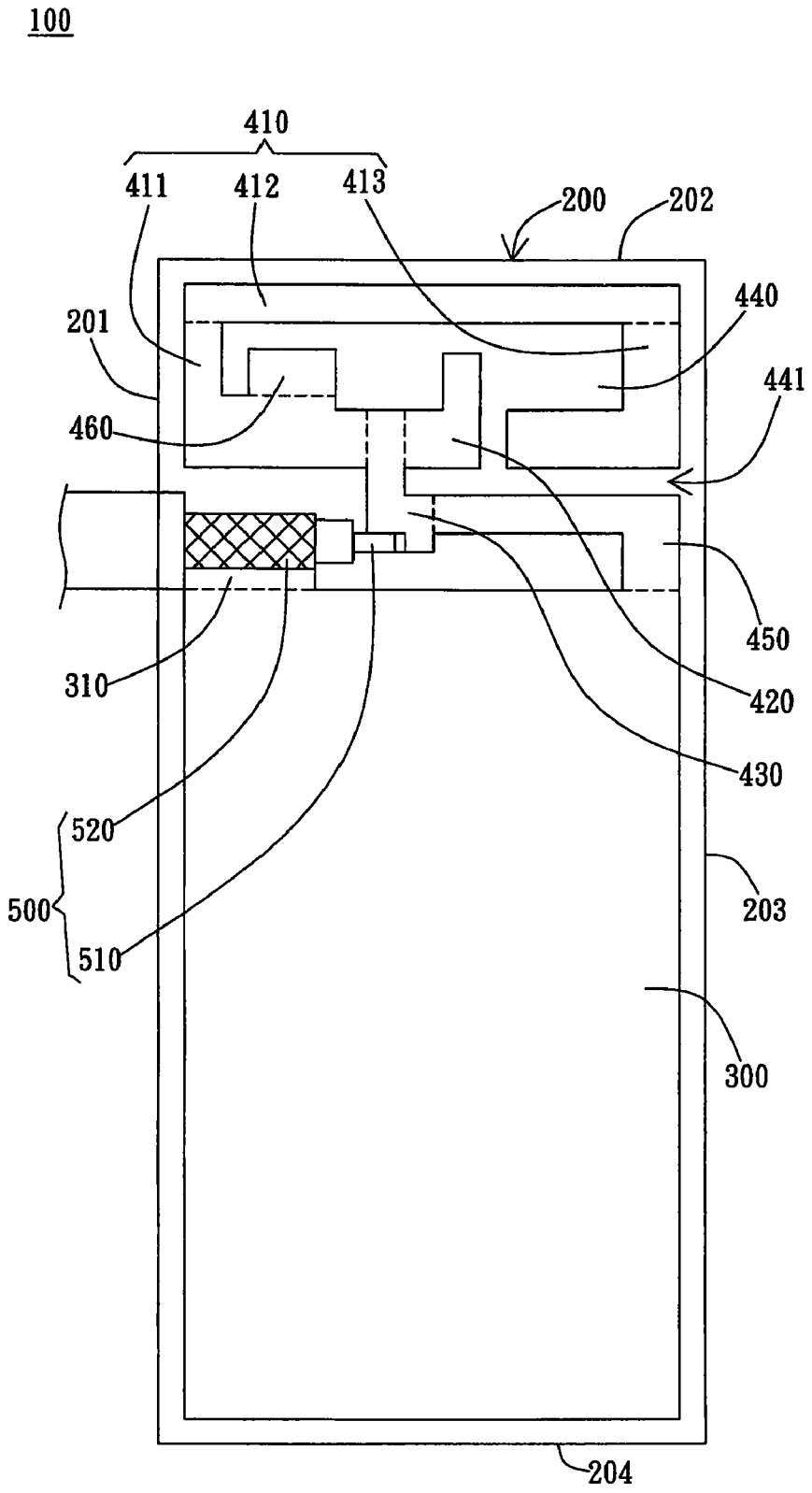
FIG. 2A illustrates a first embodiment of the wireless signal antenna of the invention.

FIG. 2A is a schematic view of a wireless signal antenna in a first embodiment of the invention. As shown in FIG. 2A, the wireless signal antenna 100 includes a substrate 200, a grounding element 300, a metal radiator element 400, and a signal transmission line 500. The substrate 200 is preferably made of plastic material, such as polyethylene terephthalate (PET), or other materials having dielectric properties, such as printed circuit boards (PCB), flexible printed circuits (FPC), etc. The substrate 200 has a first surface and an opposite second surface. In the embodiment illustrated in FIG. 2A, the thickness of substrate 200 is substantially equal to or greater than 1 mm. The length and width of the substrate 200 of the embodiment is substantially 28 mm and 13 mm respectively, but are not limited thereto. In other embodiments, the length, width, and thickness of the substrate 200 can be modified according to design or performance requirements. Furthermore, the substrate 200 includes a first edge 201, a second edge 202, a third edge 203, and a fourth edge 204. The first edge 201 and the third edge 203 are opposite to each other whereas the second edge 202 and the fourth edge 204 are opposite to each other. In the embodiment illustrated in FIG. 2A, the grounding element 300 and the metal radiator element 400 are both disposed on the first surface of the substrate 200. In the embodiment, one end of the signal transmission line 500 is electrically connected to a signal source to receive an electrical signal generated by the signal source. The other end of the signal transmission line 500 is electrically connected to the metal radiator element 400 and excites the metal radiator element 400 to generate a high frequency band mode and a low frequency band mode. In the embodiment illustrated in FIG. 2A, the high frequency band mode includes the 5 GHz frequency band defined in the wireless local area network standard IEEE 802.11. The low frequency band mode includes the 2.4 GHz frequency band also defined in the IEEE 802.11 standard. However, the high frequency band and the low frequency band are not limited thereto. In other embodiments, the metal radiator element 400 can generate different frequency modes according to the signals from the signal sources.

In the embodiment illustrated in FIG. 2A, the metal radiator element 400 includes a first radiator unit 410, a second radiator unit 420, and a signal feed-in point 430, wherein a length of the first radiator unit 410 is greater than that of the second radiator unit 420. The first radiator unit 410 and the second radiator unit 420 of the embodiment are metal strips or metal microstrips having suitable geometric shapes and are printed on the first surface of substrate 200, but are not limited thereto. In another embodiment, the first radiator unit 410 and the second radiator unit 420 can be formed on the substrate 200 by etching. As shown in FIG. 2A, one end of the first radiator unit 410 and one end of the second radiator unit 420 are both electrically connected to the signal feed-in point 430. The first radiator unit 410 and the second radiator unit 420 extend from the signal feed-in point 430. In the embodiment, the first radiator unit 410 and the second radiator unit 420 extend from two opposite sides of the signal feed-in point 430, but are not limited thereto. In different embodiments, the first radiator unit 410 and the second radiator unit 420 can extend from other parts and toward other directions.

As shown in FIG. 2A, the first radiator unit 410 has a first radiator part 411, a second radiator part 412, and a third radiator part 413. One end of the first radiator part 411 is electrically connected to the signal feed-in point 430, while the other end extends toward the first edge 201 and then a corner of the substrate 200. The second radiator part 412 of the embodiment is disposed close to the second edge 202 of the substrate 200. One end of the second radiator part 412 is disposed at the corner of the substrate 200 and electrically connected to the first radiator part 411, while the other end is disposed at the other end of the substrate 200 and electrically connected to the third radiator part 413. A part of the third radiator part 413 is disposed along the third edge 203 of the substrate 200. The third radiator part 413 is bent to have a part of the third radiator part 413 parallel to the second radiator part 412. Furthermore, in the embodiment illustrated in FIG. 2A, the metal radiator element 400 further includes a first semi-open area 440 formed between the first radiator unit 410 and the second radiator unit 420. In other words, the first semi-open area 440 is a space on the substrate 200 enclosed by both the first radiator unit 410 and the second radiator unit 420. The first semi-open area 440 has a first opening 441. In the embodiment, the first opening 441 is formed on the longer side of the first surface of the substrate 200, but is not limited thereto. In other embodiments, the shape of the first semi-open area 440 and the position of the first opening 441 can be modified in accordance with the arrangement of the first radiator unit 410 and the second radiator unit 420. Furthermore, the metal radiator element 400 further includes a protrusion 460 extending from the first radiator unit 410. The protrusion 460 is used for impedance matching between the metal radiator element 400 and the signal transmission line 500 to improve the transmission efficiency and the signal strength of wireless signals transmitted by the wireless signal antenna 100. The protrusion 460 of the embodiment extends from the first radiator part 411 toward the first semi-open area 440, but is not limited thereto. In another embodiment, the protrusion 460 can be designed to extend from the first radiator part 411 toward the grounding element 300 or to extend from other portions of the metal radiator element 400.

As shown in FIG. 2A, the signal transmission line 500 includes a signal line 510 and a ground line 520. The signal line 510 is electrically connected to the signal feed-in point 430 to excite the metal radiator element 400 by electrical signals received from a signal source (not illustrated). On the other hand, the ground line 520 is electrically connected to the grounding element 300 for providing identical voltage reference to the metal radiator element 400, the grounding element 300, and the signal transmission line 500. The signal source of the embodiment is a signal generator, but is not limited thereto. In other embodiments, the signal source can be a processor of a laptop computer or processors of other electronic devices. Furthermore, the grounding element 300 of the embodiment includes a layout area 310 formed at one end of the grounding element 300 to be electrically connected to the ground line 520 of the signal transmission line 500. In the embodiment illustrated in FIG. 2A, the signal line 510 and ground line 520 are respectively connected to the signal feed-in point 430 and the layout area 310 and disposed on the longer side of the substrate 200, but are not limited thereto. In another embodiment, the signal transmission line 500 can be connected to the signal feed-in point 430 and the layout area 310 in other positions. Furthermore, in the embodiment illustrated in FIG. 2A, the metal radiator element 400 further includes a ground connection part 450. One end of the ground connection part 450 is electrically connected to the signal feed-in point 430, while the other end extends toward one side of the first surface to be electrically connected to the grounding element 300.

Figure 2B:
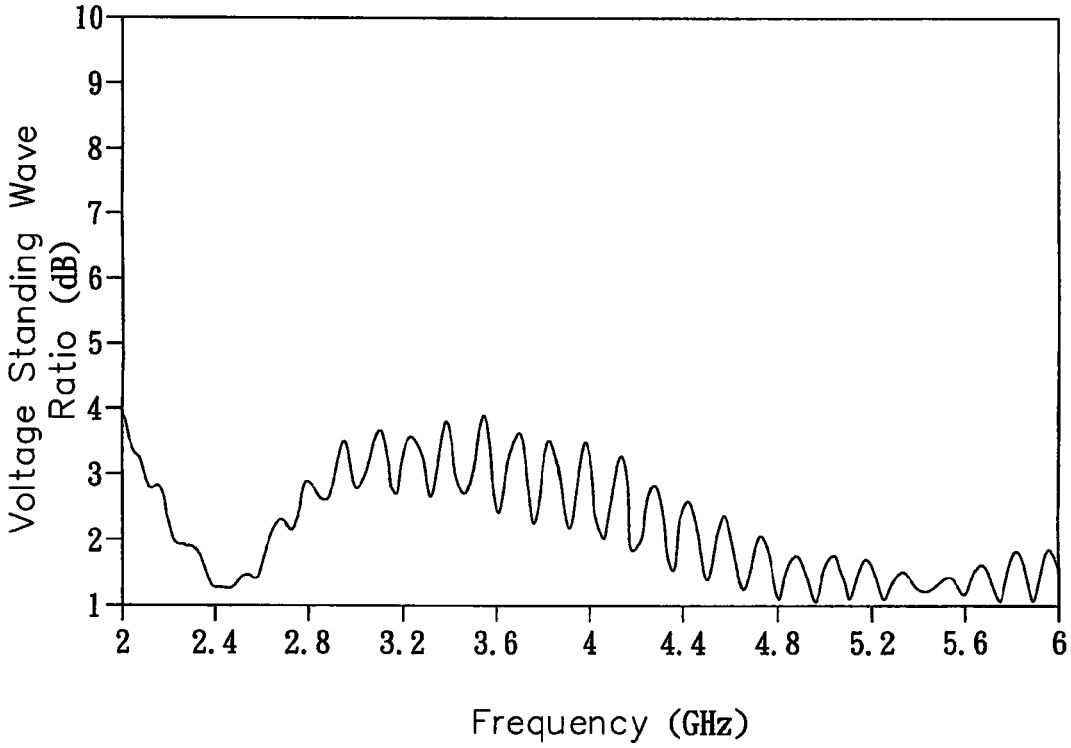
FIG. 2B is a schematic diagram illustrating the voltage standing wave ratio of the wireless signal antenna illustrated in FIG. 2A.

FIG. 2B is a schematic diagram showing the voltage standing wave ratio of the wireless signal antenna illustrated in FIG. 2A. The low frequency band mode illustrated in FIG. 2B is located around 2.4 GHz, wherein the bandwidth of the low frequency band mode having voltage standing wave ratio of 2 is substantially 0.4 GHz (=2.7 GHz−2.3 GHz). The centre frequency of the low frequency band mode is substantially 2.5 GHz [=(2.7 GHz+2.3 GHz)], and the bandwidth ratio of the low frequency band mode is 16% (=0.4/2.5*100%). As shown in FIG. 2B, the high frequency band mode is located around 5 GHz and has a plurality of crests. If voltage standing wave ratio equal to 2 is used as a standard, the effective bandwidth of the high frequency mode will be greater than that of the low frequency mode.

Figure 3:
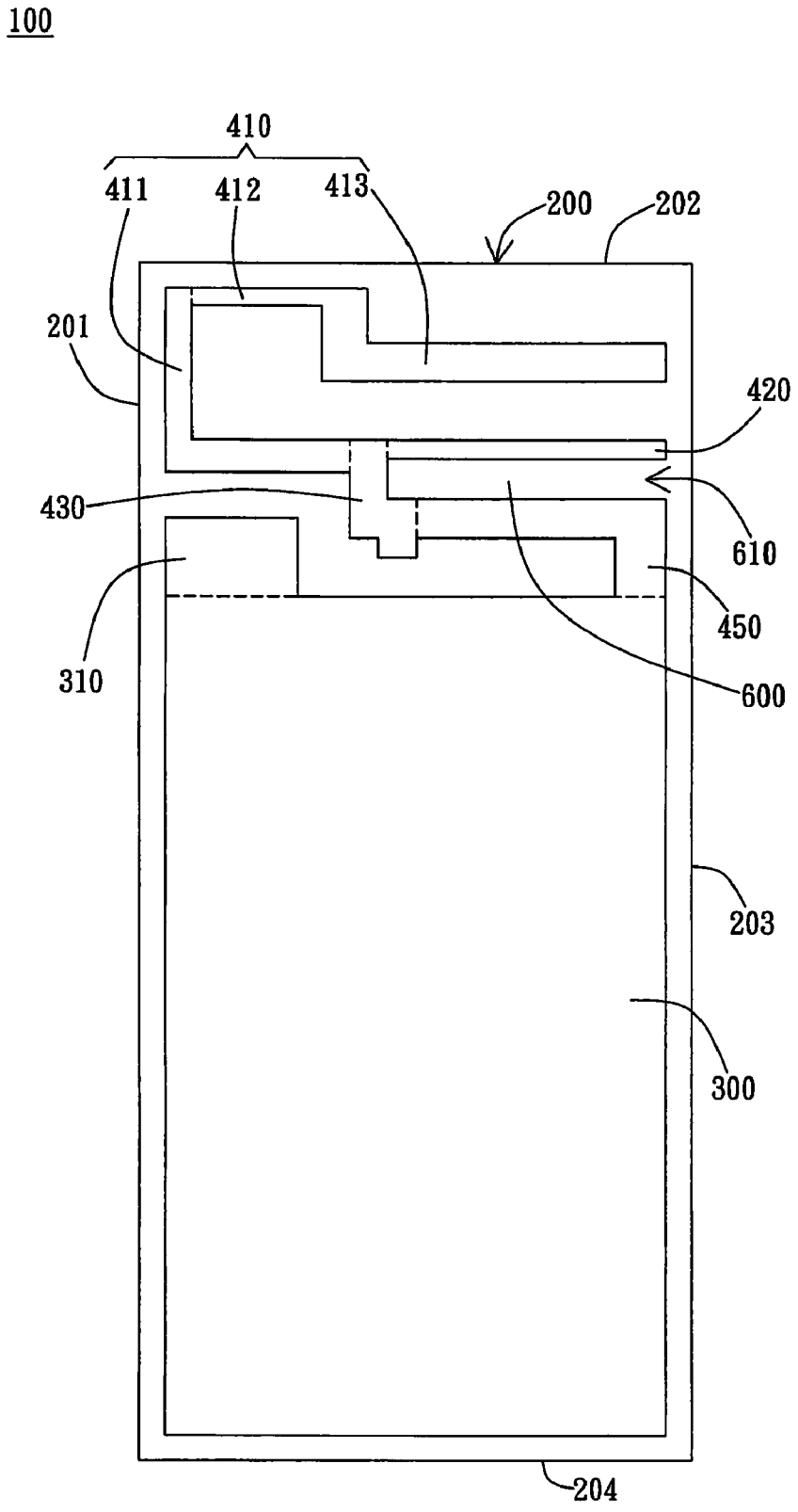
FIG. 3 illustrates a second embodiment of the wireless signal antenna of the invention.

FIG. 3 illustrates the wireless signal antenna in a second embodiment of the invention. As shown in FIG. 3, the first radiator unit 410 and the second radiator unit 420 extend from two opposite sides of the signal feed-in point 430. In the embodiment, the second radiator unit 420 has a linear shape and extends from the signal feed-in point 430 toward the third edge 203 of the substrate 200. Furthermore, a part of the first radiator part 411 is disposed close to the first edge 201 of the substrate 200. In the embodiment, the first radiator part 411 has a uniform width, but is not limited thereto. In another embodiment, segments of the first radiator part 411 can have different widths. Furthermore, the second radiator part 412 of the embodiment is disposed close to the second edge 202 of the substrate 200 and has a linear shape and a uniform width, wherein a length of the second radiator part 412 is smaller than the width of the substrate 200. Furthermore, an end of the third radiator part 413 is connected to the second radiator part 412, wherein a part of the third radiator part 413 is perpendicular to the second radiator part 412. The third radiator part 413 is bent at right angle to have a part of the third radiator part 413 extending toward the third edge 203 of the substrate 200. Furthermore, in the embodiment illustrated in FIG. 3, a second semi-open area 600 is formed between the second radiator unit 420 and the ground connection part 450. The second semi-open area 600 has a second opening 610 formed between the ground connection part 450 and an end of the second radiator unit 420.

Figure 4:
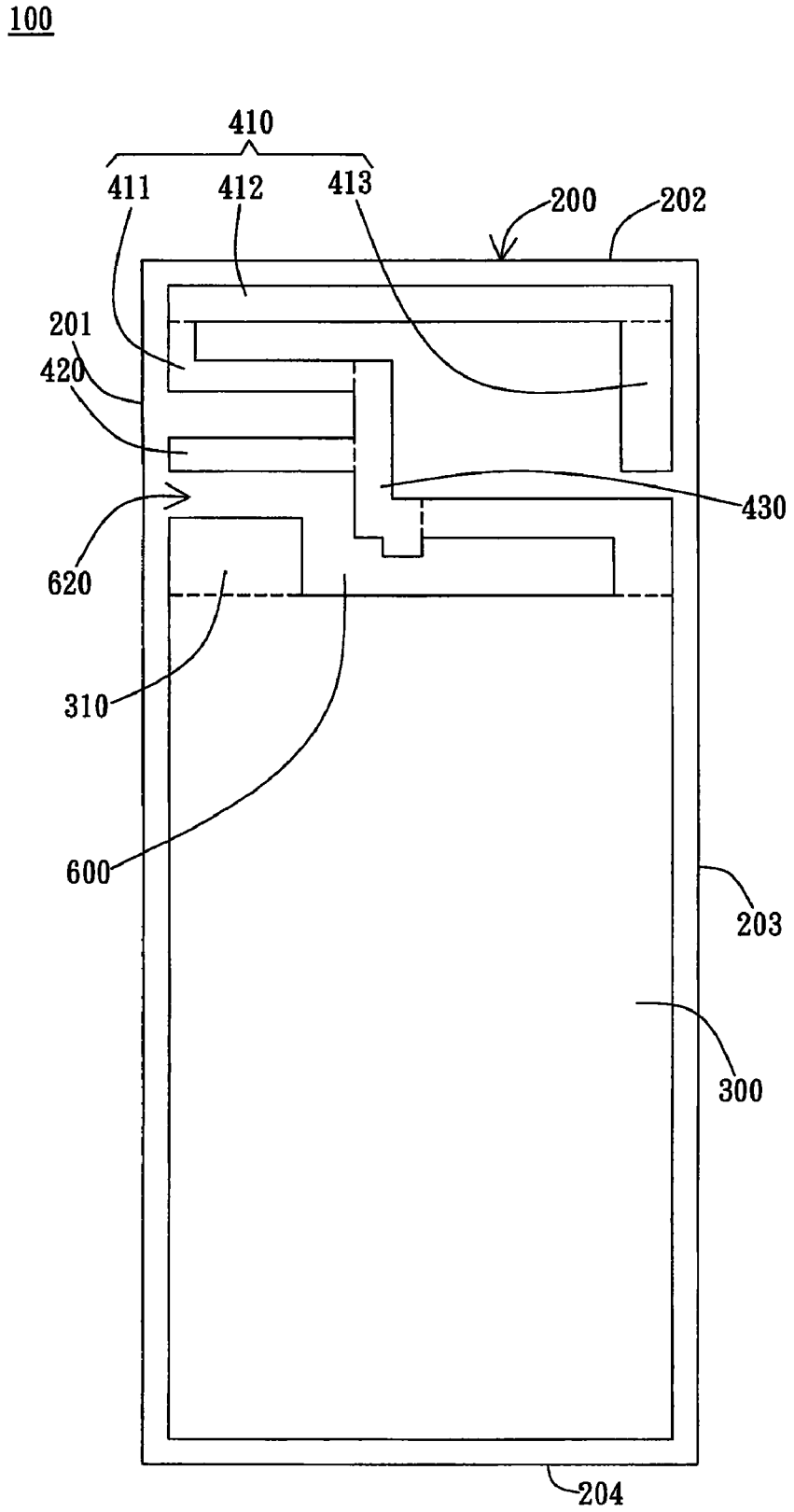
FIG. 4 illustrates a third embodiment of the wireless signal antenna of the invention.

FIG. 4 illustrates a wireless signal antenna in a third embodiment of the invention. In the embodiment, the first radiator unit 410 and the second radiator unit 420 extend from different portions of the signal feed-in point 430 toward the first edge 201 of the substrate 200. Furthermore, a second semi-open area 600 is formed between the second radiator unit 420 and the grounding element 300. The second semi-open area 600 further includes a third opening 620 formed between the second radiator unit 420 and the layout area 310.

The above is a detailed description of the particular embodiment of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A wireless signal antenna, comprising:

a substrate including a first surface, a first edge, a second edge, and a third edge, wherein the first edge is opposite to the third edge and the second edge is adjacent to the first edge and the third edge;

a grounding element disposed on the first surface;

a metal radiator element disposed on the first surface, wherein the metal radiator element includes:

a signal feed-in point for receiving an electrical signal;

a first radiator unit disposed on the first surface, wherein the first radiator unit includes:

a first radiator part, electrically connected to the signal feed-in point and extending toward and along the first edge of the substrate;

a second radiator part, electrically connected to the first radiator part and extending along the second edge of the substrate;

a third radiator part, electrically connected to the second radiator part and partially parallel to the first radiator part, wherein at least a part of the third radiator part extends toward or along the third edge of the substrate;

a second radiator unit disposed on the first surface and extending from the signal feed-in point, wherein at least a part of the second radiator unit is disposed between the grounding element and the first radiator unit;

a first semi-open area formed between the first radiator unit and the second radiator unit, wherein the first semi-open area is a space area surrounded by the first radiator part, the second radiator part, and the third radiator part; and a ground connection part having one end connected to the signal feed-in point and the other end connected to the grounding element, wherein an electrical signal excites the first radiator unit and the second radiator unit in a direct feed-in manner to generate a first frequency band mode and a second frequency band mode respectively.

2. The wireless signal antenna of claim 1, wherein the first radiator unit and the second radiator unit have different widths.

3. The wireless signal antenna of claim 1, wherein a length of the second radiator part is substantially equal to a width of the substrate.

4. The wireless signal antenna of claim 1, wherein the first semi-open area has a first opening formed on a side of the first surface and between the first radiator unit and the second radiator unit.

5. The wireless signal antenna of claim 1, wherein the first semi-open area has a first opening formed between the third radiator part and the ground connection part.

6. The wireless signal antenna of claim 1, further comprising a signal transmission line, wherein the signal transmission line includes a signal line and a ground line, the grounding element has a layout area, and the signal line is electrically connected to the signal feed-in point, wherein the layout area is a connection area formed at one end of the grounding element to be electrically connected to the ground line.

7. The wireless signal antenna of claim 6, further comprising a second semi-open area formed between the metal radiator element and the grounding element.

8. The wireless signal antenna of claim 7, wherein the second semi-open area includes a second opening formed between the ground connection part and the second radiator unit.

9. The wireless antenna of claim 7, wherein the second semi-open area includes a third opening formed between the second radiator unit and the layout area.

10. The wireless antenna of claim 1, wherein the first radiator unit has a protrusion, extending from a side of the first radiator unit.

11. The wireless antenna of claim 1, wherein a part of the first radiator unit and a part of the second radiator unit are parallel.

* * * * *